United States Patent [19]

Wrighton et al.

[11] Patent Number: 4,576,756

[45] Date of Patent: Mar. 18, 1986

[54] PRODUCTION OF HYDROGEN PEROXIDE

[75] Inventors: Mark S. Wrighton, Winchester, Mass.; Robert M. Buchanan, Louisville, Ky.; Gary S. Calabrese, Reading, Mass.

[73] Assignee: Massachusetts Institute of Technology, Cambridge, Mass.

[21] Appl. No.: 668,621

[22] Filed: Nov. 5, 1984

Related U.S. Application Data

[62] Division of Ser. No. 543,574, Oct. 19, 1983, Pat. No. 4,533,443.

[51] Int. Cl.[4] ..... C07C 50/12; H01C 13/00

[52] U.S. Cl. ..... 260/396 R; 260/501.15; 260/501.16; 260/501.21

[58] Field of Search ..... 260/396 R

[56] References Cited

U.S. PATENT DOCUMENTS 4,533,443 8/1985 Wrighton et al. ..... 204/84

FOREIGN PATENT DOCUMENTS 554319 3/1958 Canada ..... 260/396 R 598155 5/1960 Canada ..... 260/396 R

*Primary Examiner*—Richard L. Raymond

*Assistant Examiner*—Raymond Covington

*Attorney, Agent, or Firm*—James E. Maslow; Thomas J. Engellenner

[57] ABSTRACT

Methods, materials and apparatus for production of hydrogen peroxide are disclosed. In one preferred embodiment, high surface area circulating elements derivatized with a quinone catalyst are reduced in an electrolytic cell where the cathode may also be derivatized with a quinone catalyst and a solution quinone at low concentration is used as a mediator. Once reduced, the circulating elements are separated and used to form hydrogen peroxide from molecular oxygen in an aqueous, electrolyte-free, environment. The circulating elements can be cycled repeatedly. Particular, novel naphthoquinone compounds are also disclosed.

4 Claims, 3 Drawing Figures

PRODUCTION OF HYDROGEN PEROXIDE

This is a division of application Ser. No. 543,574, filed Oct. 19, 1983, now U.S. Pat. No. 4,533,443.

TECHNICAL FIELD

This invention relates to industrial chemical production and, in particular, to the electrochemical production of hydrogen peroxide.

BACKGROUND OF THE INVENTION

Attention is directed to two articles by the inventors, entitled "Electrochemical Behavior of a Surface-Confined Naphthoquinone Derivative . . . " Vol. 104, No. 21, *Journal of the American Chemical Society,* pp. 5786–5788 (1982) and "Mediated Electrochemical Reduction of Oxygen to Hydrogen Peroxide . . . ", Vol. 105, No. 17, *Journal of the American Chemical Society,* pp. 5594–5600 (1983); the teachings of both these articles are incorporated herein by reference.

Hydrogen peroxide production is a major speciality chemical operation in the United States and abroad. It is used as an oxidizing agent, bleach and, in dilute solutions, as an antiseptic. Although the constituent elements of hydroperoxide are simply hydrogen and oxygen, it has proven extremely difficult to manufacture $H_2O_2$ directly from $O_2$ and $H_2$ because water ($H_2O$) is by far the preferred reaction.

Typical reactions for producing hydrogen peroxide involve the anodic oxidation of sulfuric acid or sulfates to form peroxidic sulfuric acid or peroxidisulfates which then can be split hydrolytically at elevated temperatures to yield hydrogen peroxide recoverable by vacuum distillation. Such processes are energy-intensive and, at least, potentially hazardous due to the materials and operating conditions.

In other reactions, quinone-derivatives have been employed as catalysts for the reduction of molecular oxygen to hydrogen peroxide. In such methods the quinone is first hydrogenated and then exposed to oxygen to yield hydrogen peroxide. However, there are a number of disadvantages to this technique: first, hydrogenation of the quinone does not always yield the dihydroxy-derivative. Secondly, the hydrogen peroxide must be separated from the solvent and, finally, the quinone catalysts themselves tend to break down after repeated cycling.

There exists a need for simpler, more effective catalysts and methods for the production of hydrogen peroxide. Stable catalysts which retain their activity over repeated cycling would satisfy long-felt needs in the industry. Likewise, methods of production that permitted high yields of hydrogen peroxide free of electrolyte contamination would be most useful in this field.

SUMMARY OF THE INVENTION

We have discovered that a highly efficient system for production of hydrogen peroxide resides in the use of a quinone catalyst anchored to high surface area elements which circulate in the electrolyte solution and are used together with a cathode that may be derivatized with additional amounts of a quinone catalyst and a low concentration of a soluble quinone as a mediator. Once the quinone catalyst on the circulating elements is sufficiently reduced, the element can be removed by filtration or the like and the quinone then reacted with aqueous oxygen to yield hydrogen peroxide.

In one preferred embodiment, derivatives of 1, 4-naphthoquinone, 2-chloro-3[[2-(N', N'-dimethyl-N'-propylammonium bromide)ethyl]amino]-1, 4-naphthoquinone, Ia, and 2-chloro-3-[[2-(N', N'-dimethyl-N'-trimethoxysilyl-3-propylammonium bromide)ethyl-]amino]-1,4-naphthoquinone, Ib, are synthesized and used as solution and surface-bound catalysts, respectively, for the electrochemical or photoelectrochemical reduction of $O_2$ to $H_2O_2$. The surface derivatizing reagent Ib having the $—Si(OCH_3)_3$ functionality or a similar binding group can be used to functionalize a variety of surfaces including electrode (such as platinum, tungsten or p-tungsten sulfide, for examples) materials and high surface area oxides (such as, $SiO_2$, $Al_2O_3$, for examples) as circulating elements.

Using reagent Ib on a tungsten cathode we have found that the electrochemical reduction of $O_2$ to $H_2O_2$ occurs with greater than 90 percent current efficiency in $O_2$-saturated aqueous electrolytes (at pH=7.2) at a mass transport limited rate for electrode potentials such that the surface-bound quinone, $[Q]_{surf.}$, was held in its reduced state, $[QH_2]_{surf.}$, FIG. 1. More than $10^6$ molecules of $H_2O_2$ could be made per Q unit on the surface without significant decline in cathodic current density. It is possible to generate up to ~0.1M aqueous $H_2O_2$ free of electrolyte and quinone via the mediated reduction of naphthoquinone units anchored to high surface area $Al_2O_3$ or $SiO_2$ followed by filtration and reaction of $[SiO_2]—(QH_2)$ with $O_2/H_2O$. The synthetic scheme can be represented by the following equations:

$$Q_{(soln)}+2H^++2e^-\rightarrow QH_{2(soln)} \quad (1)$$

$$QH_{2(soln)}+[M_yO_x]—(Q)\rightarrow[M_yO_x]—(QH_2)+Q_{(soln)} \quad (2)$$

$$[M_yO_x]—(QH_2)+O_2\rightarrow[M_yO_x]—(Q)+H_2O_2 \quad (3)$$

The key features of the equations (1)–(3) are that: (i) $H_2$ is not used and the reducing power needed to make $QH_2$ is less than that necessary to make $H_2$; (ii) a low concentration of $Q/QH_2$ in solution can be employed; and (iii) the surface-bound reductant can be separated by physical means to react with aqueous $O_2$ to give pure $H_2O_2$ in $H_2O$. The procedure represented by equations (1)–(3) outlines a new way to synthesize $H_2O_2$ and can be readily extended to other redox syntheses where direct (electrode) redox reaction is undesirable.

The invention will next be described in connection with certain preferred embodiments; however, it should be clear that various changes and modifications can be made without departing from the spirit or scope of the invention. For example, although the binding group used in derivatizing our reagents to the electrodes and high surface area elements was $Si(OCH_3)_3$, other binding groups may also be employed, such as silicon alkoxides $Si(OR)_3$, boron alkoxides, silicon halides, boron dihalides, phosphorous halides and polymerizable groups, such as a styryl group. Modifications can be made to the quinone compound, as well. For example, replacing hydrogen atoms on the naphthoquinone ring with electron withdrawing substituents can favorably change the potential at which $O_2$ reduction can be effected.

DETAILED DESCRIPTION OF THE PREFERRED EMBODIMENTS

Figure 1:
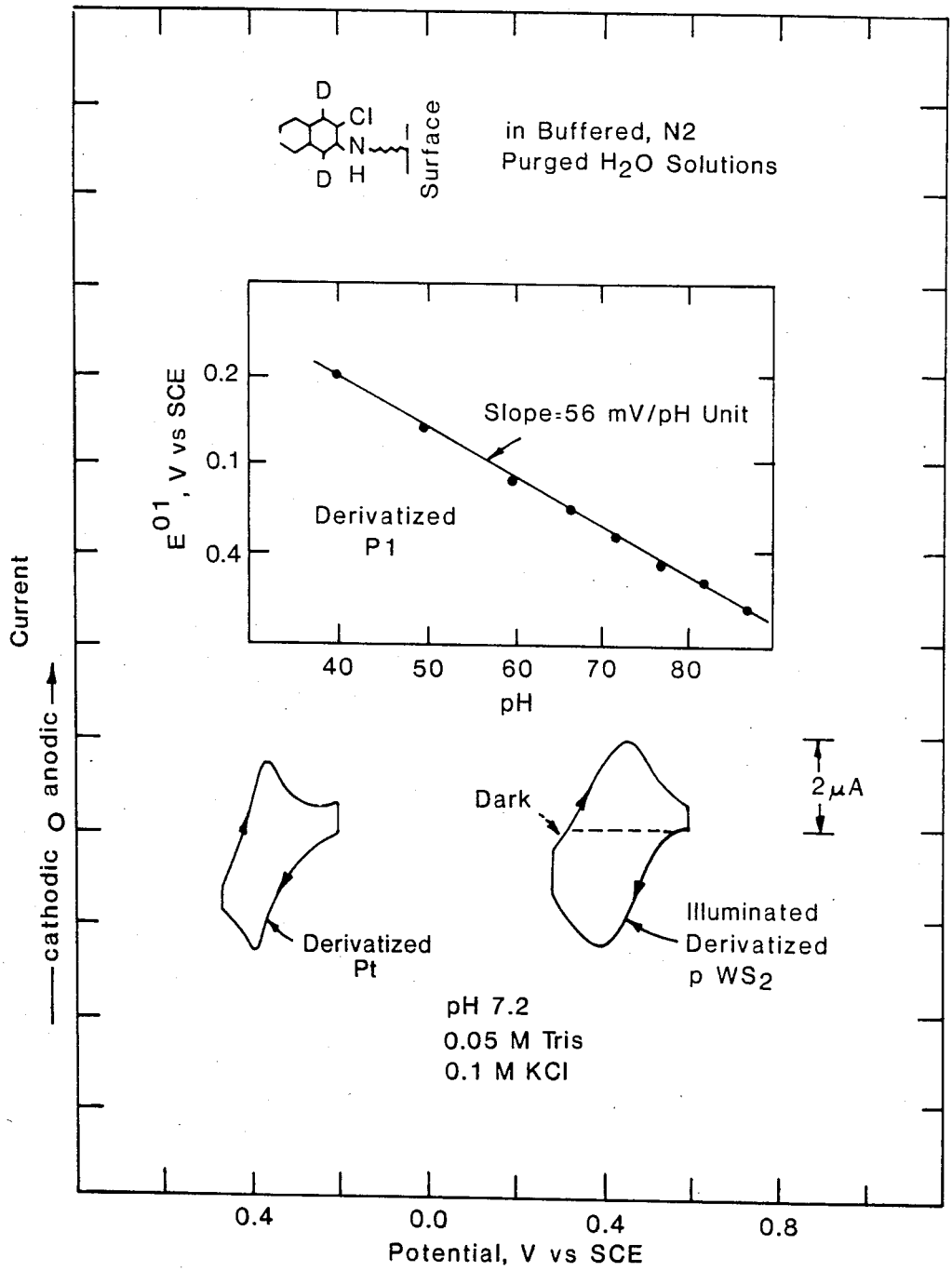
FIG. 1 shows the cyclic voltammetry for a quinone-reagent prepared and derivatized upon a platinum electrode according to our invention.

Reagents Ia and Ib were prepared according to the following equations:

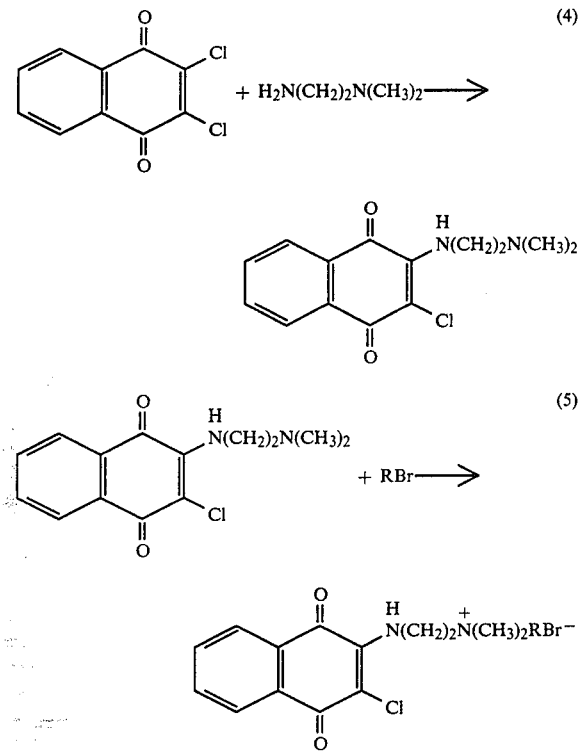

The product of equation 4, a 2-chloro-3-[[2-(dimethylamino)ethyl]amino]-1,4-naphthoquinone, II; was formed by adding 8.8 g of N, N-dimethylethylenediamine to a suspension of 22.7 g of 2, 3-dichloro-1,4-naphthoquinone in 200 ml of ethanol. The reaction mixture was stirred at room temperature overnight and then refluxed for 1 h. After cooling, a bright red precipitate was collected by filtration to give ~30 g (95% yield) of the crude HCl salt of II. The free base of II was then prepared by treating the crude product with excess aqueous $Na_2CO_3$, followed by extraction into $CH_2Cl_2$ and removal of the solvent under vacuum to yield II.

Reagent Ib was prepared as illustrated by equation 5 by stirring 1 g of II in 5 ml of $BrCH_2CH_2CH_2Si(OCH_3)_3$ [prepared by reacting $HC(OCH_3)_3$ with 1-bromo-3-(trichlorosilyl)propane purchased from Petrarch Chemical Co.] at 90° C. for 12 h, after which time the product precipitated from solution. Filtration and repeated washings with hexane followed by drying under vacuum yielded 1.6 g (~90%) of Ib. Ia was prepared in a manner analogous to Ib by stirring II with excess n-PrBr at 70° C. until the product precipitated.

The [$^1$H] NMR (270 MHz, $CD_3OD$) for Ib showed resonances at delta 0.55 (t, 2H silyl methylene, J=8 Hz); 1.78 (m, 2H, alkyl methylene); 3.13 (s, 6H, N+-methyl); 3.33 (m, 2H, N+-methylene); 3.43 (s, 9H, silyl methoxy); 3.56 (t, 2H, N+-methylene, J=6.8 Hz); 4.12 (t, 2H, N-methylene); 7.61 (m, 2H, aryl); 7.90 (d, 2H, aryl). Elemental analysis (Galbraith) for Ib was satisfactory. Calculated for $C_{20}H_{30}N_2O_5ClSiBr$: C, 46.02; H, 5.79; N, 5.37; Cl, 6.79; Si, 5.38. Found: C, 46.2; H, 5.84; N. 5.31; Cl, 6.92; Si, 5.50.

Reagent Ib was then used to derivatize the high surface area oxides and electrodes. Platinum wire (0.016" diameter), foil (0.004" thickness), or gauze (80 mesh) was fabricated into electrodes and pretreated in 0.5M $H_2SO_4$. W electrodes were soaked for 10 min in 1M $HNO_3$ prior to use. p-$WS_2$ and p-InP crystals were mounted on coiled Cu wire whose leads were passed through a 4 mm glass tube. All surfaces were then sealed with Epoxy-Patch 1C white epoxy (Hysol Division, Dexter Corp.) so as to leave only the surface of the semiconductor exposed. An ohmic contact to p-InP was made by ultrasonically soldering (Sonobond Corp.) with a 1:1 In:Cd alloy followed by attachment of a Cu wire with In solder. Ohmic contact to p-$WS_2$ was made using Ag epoxy. The InP electrodes were etched in ~1 mM $Br_2$ in $Ch_3OH$ for 60 s at 25° C. prior to use. The p-$WS_2$ electrodes were not etched prior to use, since fresh surfaces are exposed in the fabrication procedure. Platinization of p-InP was accomplished by passing $\sim 2\times 10^{-2}$C/cm$^2$ of cathodic charge at an illuminated (~40 mW/cm$^2$, 632.8 nm) p-InP electrode potentiostatted at 0.0 V vs. SCE in an $O_2$-free, aqueous 0.1M $NaClO_4$ solution containing ~1.5 mM $K_2PtCl_6$.

Electrodes and powders were derivatized for 10–24 h in dry $CH_3CN$ with 1–5 mM Ib. For concentrations of Ib near 5 mM addition of $H_2O$ (~1% by weight) was necessary to dissolve the reagent. The materials to be derivatized were suspended in the solution of Ib without stirring at 25° C. After derivatization the electrodes and powders were washed with $H_2O$ until no further quinone was removed.

The reagent Ia was first used to study its solution electrochemistry and the use of Ia as a solution mediator for reduction of $O_2$ to $H_2O_2$. We found the electrochemistry of Ia to be very well-defined in both aqueous and non-aqueous media. In dry $CH_3CN$/0.1M [n-$Bu_4N$]$C10_4$ two reversible, one-electron reductions characteristic of quinones were found. The E°'s in $CH_3CN$/0.1M [n-$Bu_4N$]$C10_4$ were at −1.25 and −0.65 V vs. SCE. We approximated the E°, value to be the average position of the anodic and cathodic current peaks. In aqueous 0.1M KCl/pH=7.2 and at the same Pt electrode the same concentration of Ia gave a single wave more positive in potential and roughly twice the area of each of the waves in $CH_3CN$/0.1M [n-$Bu_4N$]$C10_4$ confirming the 2e− process expected for quinones in aqueous media. Reduction of 1 mM Ia in $CH_3CN$/0.1M [n-$Bu_4N$]$C10_4$ at a rotating Pt disk (omega $^{\frac{1}{2}}$=10 (rad/s)$^{\frac{1}{2}}$) resulted in two current plateaus of equivalent height, consistent with the two, well-separated one-electron cyclic voltammetry waves. In aqueous 0.1M KCl/pH-7.2 reduction of 1 mM Ia at the rotating disk (omega $^{\frac{1}{2}}$=10 (rad/s)$^{\frac{1}{2}}$ resulted in only one limiting current plateau that coincides in height with the overall two-electron limiting current in $CH_3CN$/0.1M [n-$Bu_4N$]$C10_4$. Further, the potential of the reduction wave for Ia in aqueous KCl was found to vary by ~60 mV per pH unit over the range pH from 4 to 9 as was expected for the $2e^- - 2H^+$ reduction. The E°, at pH=7.2 was −0.38 V vs. SCE.

The current efficiency for the reduction of Ia to the dihydroxy species, equation (6) below, was determined at a Pt cathode held at −0.5 V vs. SCE in a two-compartment cell containing 0.1M KCl/pH=7.2 with 0.15 mM Ia in the catholyte:

$$\underline{Ia} + 2H^+ + 2e^- \xrightarrow[\text{0.1 M KCl, pH = 7.2}]{-0.5\ V} \quad (6)$$

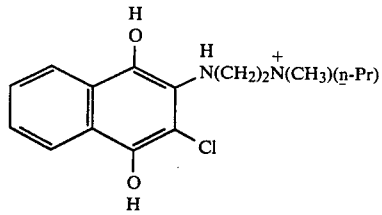

By monitoring the decrease in optical density of the catholyte at 460 nm (corresponding to Ia) as a function of charge passed we determined that the $2e^- - 2H^+$ reduction process occurs with 100% current efficiency, within experimental error. Exposure of the solution to $O_2$ rapidly and quantatively regenerated Ia and yielded a stoichiometric amount of $H_2O_2$.

An examination of an $O_2$-saturated 0.1M KCl/pH=7.2 aqueous solution of 1.0 mM Ia at a rotating W disk electrode revealed that the rate of the solution reaction of the reduced form of Ia with $O_2$ was very fast, FIG. 1. The study of Ia in the presence of $O_2$ was carried out at a W electrode, since there was negligible current attributable to $O_2$ reduction without Ia. In the presence of Ia a plot of the plateau current vs. omega $^{1/2}$ was a straight line with zero intercept for an electrode potential more negative than ~0.6 V vs. SCE. The absolute current density was consistent with a mass transport limited reduction of the $O_2$/Ia material available up to a rotation speed of 1900 rpm. Further, a cyclic voltammogram at W in the same solution showed a catalytic prewave ~60 mV more positive than the peak for reduction of Ia at a sweep rate of 20 mV/s. The catalytic prewave was consistent with a very fast homogeneous reduction of the $O_2$ via the dihydroxy product from reducing Ia. Thus, the reduction of Ia in the presence of $O_2$ comprised a classic solution EC′ system where Ia is reduced and regenerated in an irreversible following reaction with $O_2$ leading to $H_2O_2$ formation.

The reagent Ib was next used to study the mediated reduction of $O_2$ to $H_2O_2$ at derivatized electrodes. The behavior of electrodes bearing approximately monolayer amounts (~$10^{-10}$ mol/cm$^2$) of Ib was also well-defined in aqueous media. The $[Q/QH_2]_{surf.}$ system had an E°′ within 50 mV of the E°′ for Ia as measured by cyclic voltammetry at Pt, and exhibited the expected ~60 mV/pH unit shift. The peak current was directly proportional to sweep rate below 50 mV/s, and the electrodes were durable for thousands of cycles between the oxidized and reduced forms.

Cyclic voltammetry was also studied for a derivatized electrode bearing significantly greater than monolayer coverage of the $[Q/QH_2]_{surf.}$. The larger coverages can be achieved by longer derivatization times. Electrodes bearing polymeric quantities of the $[Q/QH_2]_{surf.}$ system from reaction with Ib can firmly bind large transition metal complexes such as $Fe(CN)_6^{3-/4-}$. The firm binding of such complex anions can be attributed to the positive charge on the Q units.

We also found, by rotating disk experiments with derivatized W electrodes, that $O_2$ was reduced with a minimum heterogeneous rate constant of 0.013 cm/s at an electrode potential of −0.5 V vs. SCE. The reduction of $O_2$ to $H_2O_2$ was mass transport limited up to a rotation speed of 1900 rpm at a derivatized W disk bearing about ~$10^{-10}$ mol/cm$^2$ of the $[Q/QH_2]_{surf.}$ held in the $[QH_2]_{surf.}$ state for a pH range of 5.8 to 8. The minimum heterogeneous rate constant was deduced from the strict linearity of the plot of limiting current against (rotation velocity)$^{1/2}$. Note that the rate constant does not have the usual potential dependence. The lower limit then on the rate constant, k, for equation (7) is $0.65 \times 10^5 M^{-1}s^{-1}$:

$$[QH_2]_{surf.} + O_2 \xrightarrow{k} H_2O_2 + [QH_2]_{surf.} \quad (7)$$

The two-stimuli response of a p-type semiconductor electrode was used to prove that the $[QH_2]_{surf.}$ was oxidized by reaction with $O_2$. The p-$WS_2$ electrode blocked reduction in the dark, but upon illumination with light of energy greater than the band gap (Eg≃1.3 eV) the reduction of $[Q]_{surf.}$ was effected at an electrode potential ~0.8 V less reducing than at a metallic electrode such as Pt or W. At the negative limit of the scan, the light was blocked and the dark $[QH_2]_{surf.}$—$[Q]_{surf.}$ process occurred on the return sweep. In the presence of $O_2$ the derivatized p-$WS_2$ gave more photocurrent than that associated with $[Q]_{surf.}$, consistent with the mediated reduction of $O_2$. The key point, however, was that in the presence of $O_2$ there is no return wave for $[QH_2]_{surf.}$—$[Q]_{surf.}$, indicating that $[QH_2]_{surf.}$ was indeed being oxidized by $O_2$ and at a rate which was competitive with oxidation by the electrode.

The mediated reduction of $O_2$ to $H_2O_2$ at derivatized W electrodes was sustained for prolonged periods of time. In an experiment with a rotating disk electrode at omega $^{1/2}$=14.0 (rad/s)$^{1/2}$ held at −0.5 V vs. SCE in 10 ml of $O_2$-saturated 0.1M KCl/pH=7.2 catholyte in a two-compartment cell, there was a slight decline in current over a 5 h period, but the total charge passed represents $>10^6$ turnovers of $[Q/QH_2]_{surf.}$. This resulted in the formation of ~2 mM $H_2O_2$ with >90% current efficency. The cyclic voltammetry for the derivatized electrode in the absence of $O_2$ both before and after the mediation revealed that the mediated reduction of $O_2$ resulted in loss of ~50% of $[Q]_{surf.}$. The small decline in current density observed even with this large loss of $[Q]_{surf.}$ was not surprising, however, since the reduction of $O_2$ was mass transport limited under the conditions employed.

Furthermore, the electrochemical reduction of naphthoquinone anchored to high surface area oxides was studied. The direct reduction of $O_2$ to $H_2O_2$ using electrodes derivatized with Ib was efficient and sustained to generate significant concentrations of $H_2O_2$. Even at 0.1M $H_2O_2$, the W/$[Q/QH_2]_{surf.}$ electrodes effected $O_2$ reduction competitively with reduction of the $H_2O_2$. However, the electrochemical reduction of $O_2$ to $H_2O_2$ by necessity meant the $H_2O_2$ solution contained supporting electrolyte, and high concentrations of $H_2O_2$ did give more rapid decline in catalytic activity of the $[Q/QH_2]_{surf.}$ system. In order to circumvent the problem of having the electrolyte as an impurity, we adopted the strategy represented by equations (1)-(3) in the summary. Additionally, this strategy avoids prolonged contact of the $[Q/QH_2]_{surf.}$ system with high concentrations of $H_2O_2$. Basically, the objective is to heterogenize the $QH_2$ on high surface area material to facilitate its separation from the electrolyte solution. The solid bearing the $QH_2$ functionality then can be exposed to $O_2/H_2O$ to prepare $H_2O_2/H_2O$ that is free of electrolyte. The resulting suspension of surface-confined Q then can be separated by filtration from the $H_2O_2/H_2O$ solution. High surface area $Al_2O_3$ (225 $m^2/g$) and $SiO_2$ (400 $m^2/g$) have been employed as materials to which the $Q/QH_2$ system is covalently anchored. Both $Al_2O_3$ and $SiO_2$ are inert to $H_2O_2$ and do not decompose $H_2O_2$. The high surface area means that a significant fraction of the mass of the derivatized surface can in fact be the $Q/QH_2$ system.

High surface area $SiO_2$ and $Al_2O_3$ were derivatized using Ib to yield $[SiO_2]$—(Q) or $[Al_2O_3]$—(Q), respectively. The colorless powders became orange upon derivatization with Ib. The $[Al_2O_3]$—(Q) was analyzed and found to be ~0.1 mmol of Q per gram of material. This is about an order of magnitude below the Q content in pure Ib which is ~2 mmol per gram of material.

The $[Al_2O_3]$—(Q) and $[SiO_2]$—(Q) were durable and were washed repeatedly with aqueous electrolyte or with $H_2O$ without removal of Q. Importantly, the $[SiO_2]$—(Q) and $[Al_2O_3]$—(Q) were durable to reduction and subsequent oxidation with $O_2$. For example, aqueous $S_2O_4^{2-}$ can be used to reduce the surface-bound quinone by adding $Na_2S_2O_4$ to a suspension of the $[M_yO_x]$—(Q) in deoxygenated $H_2O$. The orange powder becomes off-white almost instantly upon mixing, consistent with the chemistry represented by equation (8).

$$[M_yO_x]\text{—}(Q)+S_2O_4^{2-}+2H^+\rightarrow[M_yO_x]\text{—}(QH_2)+2SO_2 \quad (8)$$

Filtering the solution to isolate the off-white powder under $N_2$ followed by washing the powder with deoxygenated $H_2O$ yields an off-white powder. The off-white color was consistent with $[M_yO_x]$—$(QH_2)$, since reduction of Ia in aqueous electrolyte solutions gave the dihydroxy compound that has no visible absorption maximum. Exposure of the off-white powder from $S_2O_4^{2-}$ reduction to a known volume of $O_2$-saturated $H_2O$ regenerated the orange color and analysis of the aqueous solution showed a concentration of $H_2O_2$ consistent with the amount of Q initially present as $[M_yO_x]$—(Q). The highest concentration of $H_2O_2$ achieved by this procedure was ~0.1M $H_2O_2$ in electrolyte-free $H_2O$. Note that the material from derivatization with Ib always had a compensating anion, since the reagent had a positive charge. However, when aqueous $O_2$ reacts with $[M_yO_y]$—$(QH_2)$ there is no additional electrolyte necessary.

Figure 2:
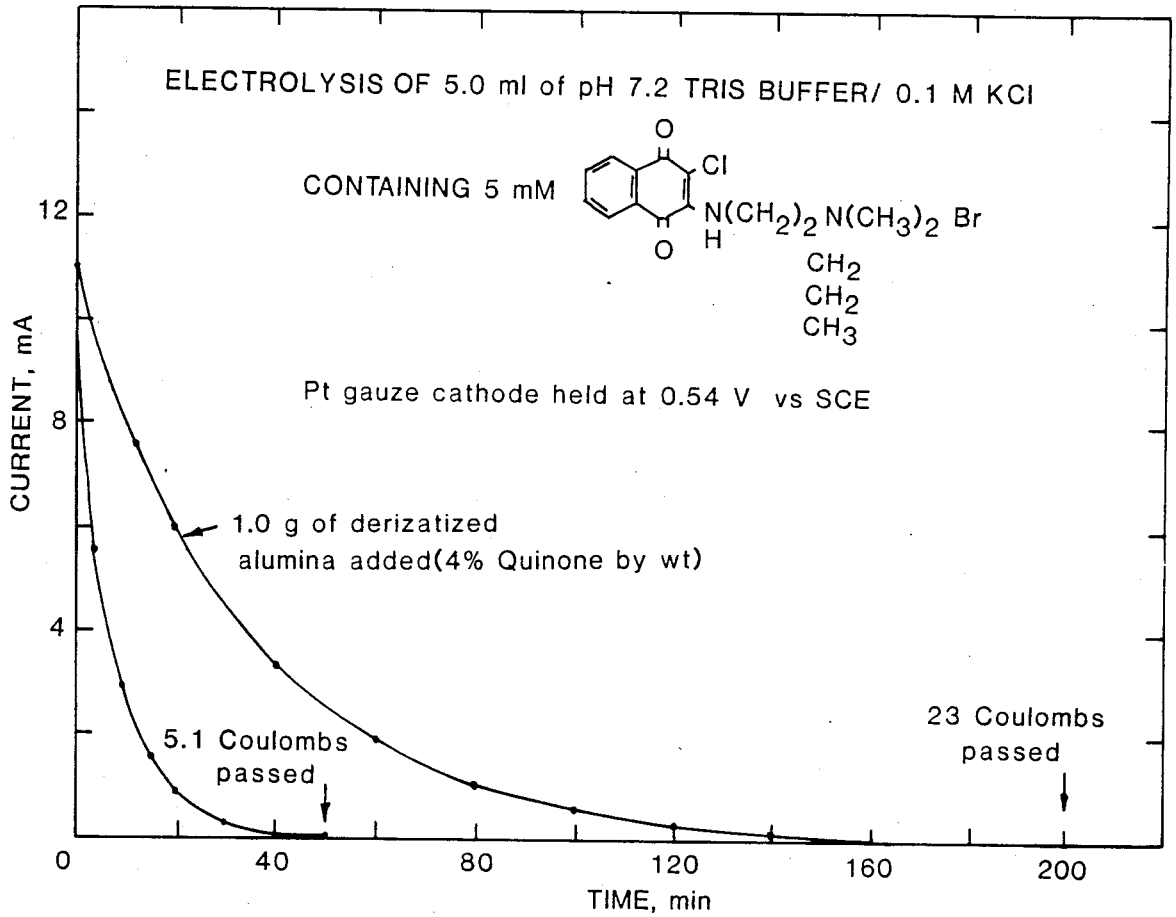
FIG. 2 is a plot of cathodic current vs. time for a platinum electrode in the cathode compartment of a two compartment cell constructed according to our invention.

The $[M_xO_y]$—(Q) powders was not electroactive as a suspension in aqueous (pH=7.2) electrolyte solution. The addition, for example, of 1.0 g of $[Al_2O_3]$—(Q) to 10 ml of a 0.1M KCl/pH=7.2 electrolyte solution gave no increase in current for a Pt gauze electrode held at −0.5 V vs. SCE. This underscored the fact that the $Q/QH_2$ system is persistently attached to the $M_xO_y$ surface, since quinone in solution is electroactive. The reduction of the surface-bound quinone, however, can be effected by using Ia as a solution mediator. Data in FIG. 2 shows that the mediated reduction of the surface-bound quinone can be effected in the cathode compartment of a two compartment cell by having 5 mM Ia in the electrolyte solution. The charge passed associated with reducing Ia+$[Al_2O_3]$—(Q) was consistent with the total amount of quinone present. The ability of Ia to serve as a mediator was consistent with its own electrochemical behavior at Pt and with the ability to reduce Ia at a mass transport limited rate at a rotating disk electrode derivatized with Ib. Addition of $O_2$ to the solution after generation of the dihydroxy product from Ia and the $[Al_2O_3]$—$(QH_2)$ resulted in the formation of $H_2O_2$ in an amount consistent with the total available $QH_2$. Table I summarizes the results of several such experiments, including experiments using $S_2O_4^{2-}$ to reduce the $[M_xO_y]$—(Q) to $[M_xO_y]$—$(QH_2)$. As shown by the mediation experiments, significantly more $H_2O_2$ was made than Ia initially present. The derivatized powders were durable, and even in the presence of 0.1M $H_2O_2/H_2O$ did not undergo decomposition on the several-minute timescale required to remove the $[M_xO_y]$—(Q) by filtration.

TABLE I

Chemical and Mediated Electrochemical Reduction of $[M_xO_y]$—(Q) to $[M_xO_y]$—$(QH_2)$ to Reduce $O_2$ to $H_2O_2$.

| Powder (mass, g)[a] | Solution Volume, ml[b] | Reduction Method[c] | Charge Passed, C[d] | $H_2O_2$ Detected, M[e] | Efficiency[f] |
|---|---|---|---|---|---|
| $[Al_2O_3]$—(Q) (1.0)[g] | 5.0[g] | Mediation, 5 mM Ia[g] | 23.0[g] | 0.02[g] | 90[g] |
| $[Al_2O_3]$—(Q) (1.0) | 8.0 | Mediation, 0.5 mM Ia | 14.3 | 0.01 | 100 |
| $[Al_2O_3]$—(Q) (0.5) | 8.0 | Mediation, 0.5 mM Ia | 7.5 | 0.005 | 100 |
| $[Al_2O_3]$—(Q) (1.0) | 0.5 | $S_2O_4^{2-}$ | — | 0.095 | >90 |
| $[SiO_2]$—(Q) (1.0) | 5.0 | $S_2O_4^{2-}$ | — | 0.012 | >80 |
| $[SiO_2]$—(Q) (0.5) | 2.0 | $S_2O_4^{2-}$ | — | 0.015 | >90 |

[a]High surface area $SiO_2$ or $Al_2O_3$ derivatized with Ib. Analysis shows −0.1 mmol of Q per gram of derivatized powder.
[b]Volume of oxygenated $H_2O$ added to $[M_xO_y]$—$(QH_2)$. In the case of the electrochemical reduction this is also the volume of the catholyte solution used in the experiment.
[c]"Mediation" refers to the electrochemical reduction of a suspension of $[M_xO_y]$—(Q) in 0.1 M KCl/pH = 7.2 containing the indicated concentration of Ia. The reduction is carried out at a Pt electrode at −0.5 V vs. SCE in a two compartment cell with the $[M_xO_y]$—(Q) and Ia in the cathode compartment. Reduction with $S_2O_4^{2-}$ was carried out by adding excess $Na_2S_2O_4$ to an aqueous suspension of $[M_xO_y]$—(Q) followed by filtering and washing with deoxygenated $H_2O$. Finally, the indicated volume of $H_2O$ was used to suspend the $[M_xO_y]$—$(QH_2)$ and $O_2$ was added.
[d]Charge passed in the mediated electrochemical reduction. Includes $QH_2$ and $[M_xO_y]$—$(QH_2)$ formation.
[e]$H_2O_2$ concentration detected in the volume indicated. For mediated electrochemical reduction the $H_2O_2$ comes from both $QH_2$ and $[M_xO_y]$—$(QH_2)$ reaction with $O_2$. For the $S_2O_4^{2-}$ reduction $[M_xO_y]$—$(QH_2)$ was isolated in a pure state prior to reaction with $O_2/H_2O$.
[f]Based on the total $QH_2$ available for reaction with $O_2$.
[g]These data correspond to plot in FIG. 2.

Figure 3:
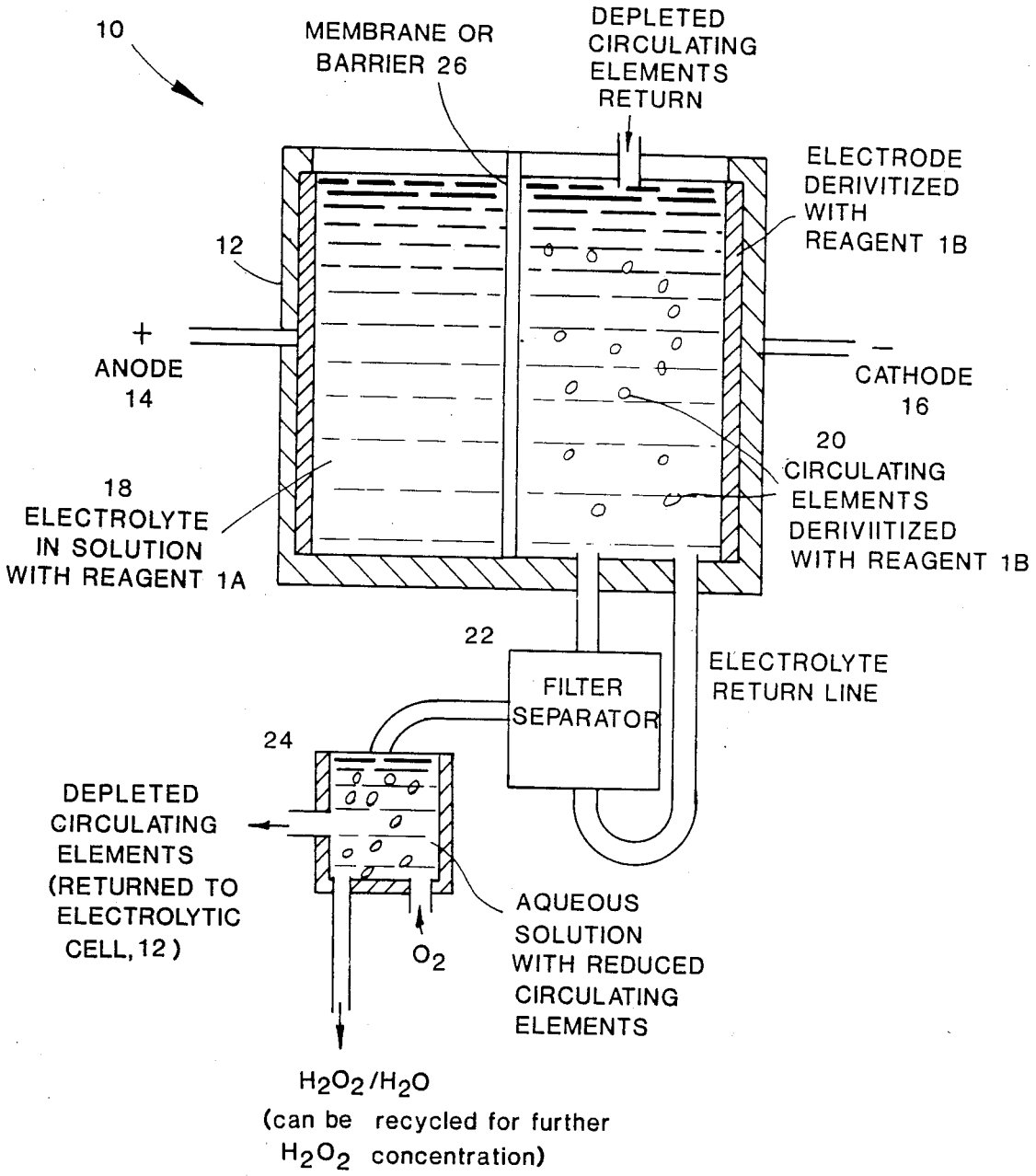
FIG. 3 is a schematic diagram of an apparatus for production of hydrogen peroxide according to our invention.

In FIG. 3 an apparatus 10 for industrial production of hydrogen peroxide is shown comprising an electrolytic cell 12, a filter/separator 22, reducing chamber 24 and the appurtenant feed and return lines. The electrolytic cell 12 includes an anode 14, a cathode 16 (which, preferably, is derivatized with reagent Ib or a related surface-confined quinone compound) and electrolyte 18 (which includes the soluble reagent Ia or another mediating agent). The cell is separated into two compartments by barrier 26 (which can be a fine mesh or membrane material) and the cathodic compartment further includes a plurality of high surface area circulating elements 20 which are also derivatized with reagent Ib or a related compound.

The filter/separator 22 serves to remove the circulating elements 20 from the electrolyte solution 18 after the derivatized-quinone has been reduced. The reduced elements 20 are then introduced into chamber 24 where they are used to reduce molecular oxygen to hydrogen peroxide in an electrolyte-free aqueous environment. The depleted elements 20 are then recirculated into the electrolytic cell 12 to begin the process anew and the $H_2O_2$ formed in chamber 24 can be withdrawn or recycled (or may remain) in the chamber 24 for further concentration.

What we claim is:

1. A compound having the formula:

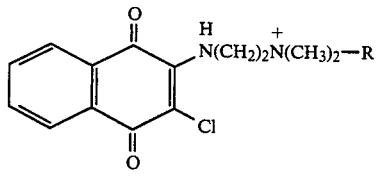

wherein R is a lower alkyl, or aryl group.

2. A salt of the compound of claim 1 further comprising a halogen or other anion for charge balance.

3. A compound having the formula:

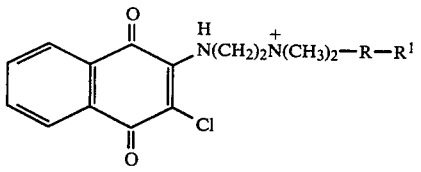

where R is a lower alkyl or aryl group and $R^1$ is a binding group chosen from the group of silicon alkoxides, silicon halides, boron alkoxides, boron halides, phosphorous halides, or a styryl group.

4. A salt of the compound of claim 3 further comprising a halogen or other anion for charge balance.

* * * * *